US005702008A

United States Patent [19]

Thalenfeld et al.

[11] Patent Number: 5,702,008

[45] Date of Patent: Dec. 30, 1997

[54] MERCHANDISE DISPLAY HOOK WITH POSITIONING SUPPORT FOR PIVOTING LABEL HOLDER

[75] Inventors: David R. Thalenfeld, Bear Creek, Pa.; Thomas O. Nagel, Blairstown, N.J.

[73] Assignee: Trion Industries Inc., Wilkes-Barre, Pa.

[21] Appl. No.: 681,012

[22] Filed: Jul. 22, 1996

[51] Int. Cl.[6] ..... A47F 7/00

[52] U.S. Cl. ..... 211/57.1

[58] Field of Search ..... 211/57.1, 59.1; 248/220.31, 220.41; 40/642

[56] References Cited

U.S. PATENT DOCUMENTS

| | | | |
|---|---|---|---|
| 4,246,710 | 1/1981 | Mixer | 211/57.1 X |
| 4,394,909 | 7/1983 | Valiulis et al. . | |
| 4,540,093 | 9/1985 | Merl et al. . | |
| 4,801,116 | 1/1989 | Blankenship . | |
| 4,821,437 | 4/1989 | Abramson et al. . | |
| 5,088,606 | 2/1992 | Boas . | |
| 5,235,766 | 8/1993 | Fast et al. . | |
| 5,348,167 | 9/1994 | Jensen | 211/59.1 X |
| 5,441,161 | 8/1995 | Merl | 211/57.1 |
| 5,442,872 | 8/1995 | Moser . | |
| 5,456,034 | 10/1995 | Lewis et al. . | |
| 5,485,930 | 1/1996 | Rushing | 211/59.1 |

*Primary Examiner*—Alvin C. Chin-Shue
*Assistant Examiner*—Sarah L. Purol
*Attorney, Agent, or Firm*—Schweitzer Cornman Gross & Bondell LLP

[57] ABSTRACT

A merchandise display hook provided with an improved form of pivoting label holder. A merchandise supporting arm extends below and terminates forwardly of a label supporting arm. A cross bar provides a pivot mount for a plastic label holding device, with the end extremity of the merchandise support arm serving as an abutment stop to limit rearward pivoting movement of the label holder. The cross bar can be so positioned as to provide for a normal, slightly upwardly tilted orientation of the label holder, to facilitate viewing. In one embodiment, the cross bar is welded to the shaft of the label support arm. In other embodiments, the label support arm is bent to form a cross bar at right angles to the shaft.

11 Claims, 4 Drawing Sheets

12

FIG. 5
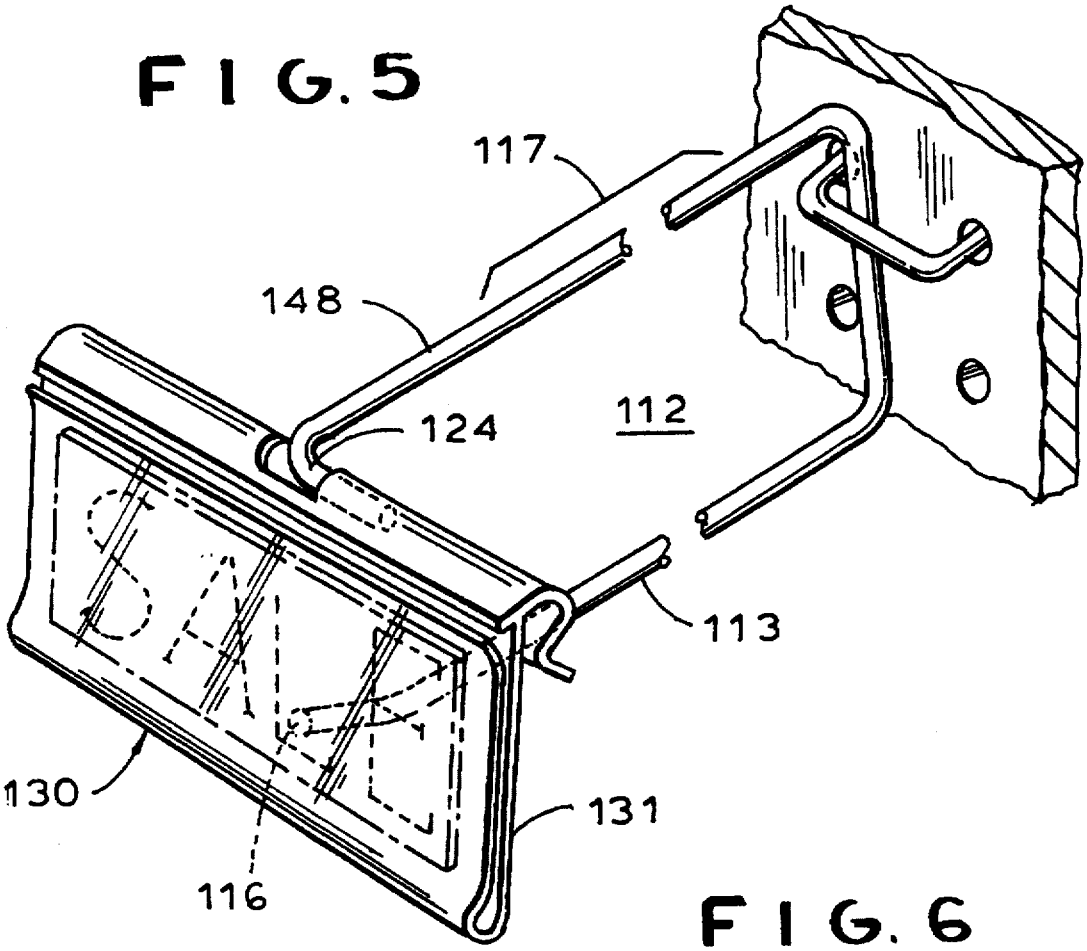
FIG. 6
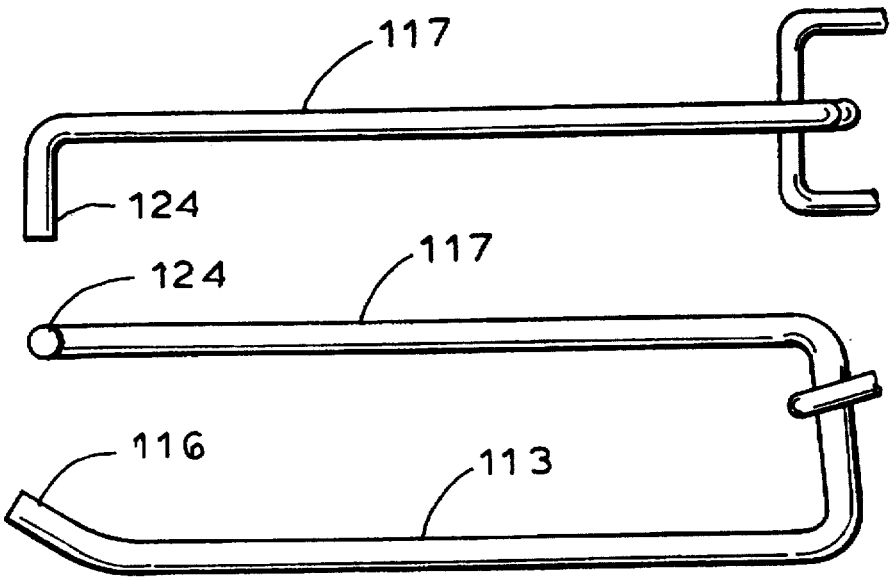
FIG. 7

FIG. 8
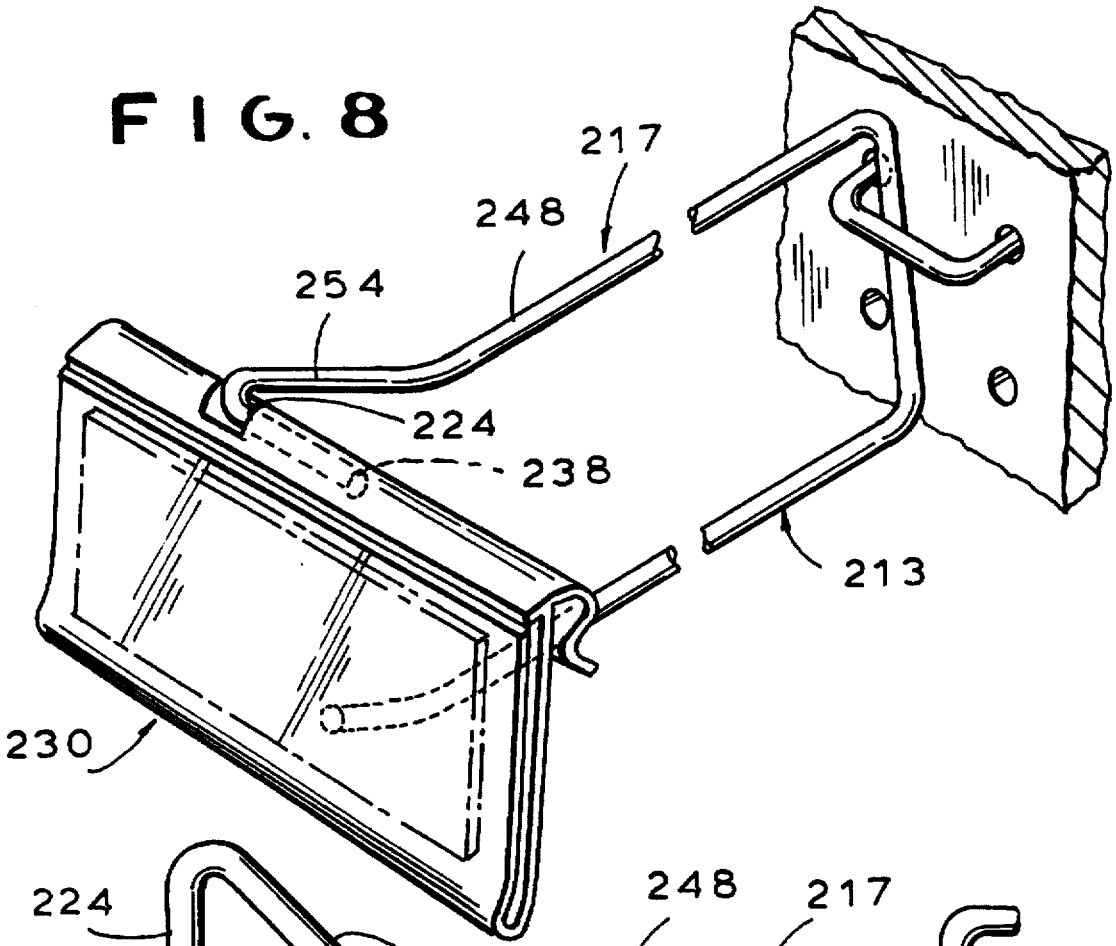
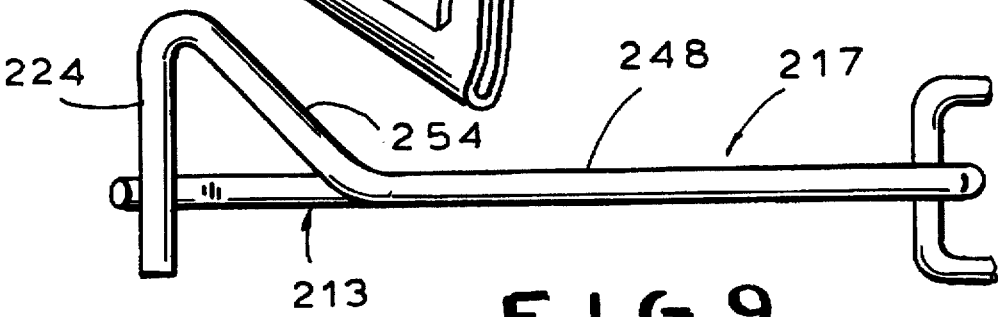
FIG. 9
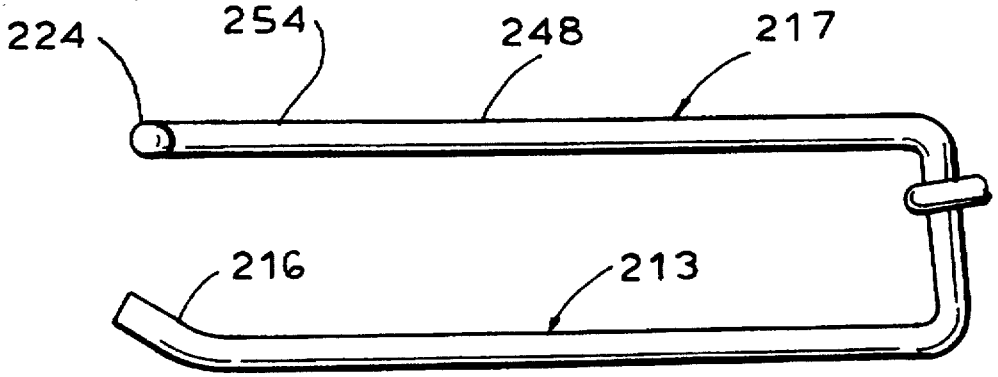
FIG. 10

MERCHANDISE DISPLAY HOOK WITH POSITIONING SUPPORT FOR PIVOTING LABEL HOLDER

BACKGROUND AND SUMMARY OF THE INVENTION

Display hooks, typically mounted on apertured panel board, slotted panels or the like are in widespread usage for displaying cared merchandise for sale. In many cases, such merchandise display hooks are combined with label-mounting means for presenting product information and pricing in association with the carded merchandise. A common form of such label-mounting means consists of an arm projecting above and generally parallel to a merchandise supporting arm and mounting a label-holding device at its forward extremity, usually in a position directly in front of the outer end of the merchandise display hook. The label-holding device, in such cases, serves an additional function as a means for guarding the outer end of the display hook element against accidental contact.

One of the known label-mounting means for this purpose comprises a wire-like element extending outward, above the merchandise support, and terminating at its outer extremity in a welded-on cross bar element. The cross bar element serves as a pivoting support for a plastic label holder, allowing the label holder to hang downward in front of the outer end of the merchandise support. The pivoting action of the label holder facilitates product removal from the associated product support. If a product being withdrawn forwardly from its display hook engages the plastic label holder, the holder can simply pivot upward out of the way as necessary to allow the product to clear. An additional advantage of pivoting label holders in general is that, with respect to product items displayed at a low level, viewing of the product information and pricing is facilitated by allowing the customer to simply reach down and tilt the label holder upwardly, rather than having to bend or crouch to read the contents of the label.

The present invention is directed to a merchandise display hook of the general type described above, including a pivoted label holder arrangement, which is both improved with respect to known constructions and is at the same time capable of more economical manufacture. To this end, the device of the invention includes a merchandise support element with an end which extends beyond the cross bar element on the label support arm such that a plastic label holder extending from the label support arm to the end of the merchandise support element is held in an inclined angle. In one form of the device according to the invention, the outer extremity of the merchandise support element is bent Upward typically at an angle of approximately 40°, defining a label positioning element.

The cross bar element may be an integral section of the label support arm bent at a right angle with respect to the shaft thereof. Alternatively, the cross bar element may be an independent section mounted near the end of the label support arm by welding the cross bar element to an upper-outer surface of the end portion of the label support arm. When the label holder is mounted on the cross bar, the positioning element, extending upwardly and forwardly beyond the cross bar, serves as an abutment, to limit rearward pivoting movement of the label holder. This not only prevents backward tilting of the label holder, as can occur with existing designs, but additionally allows for the merchandise display hook to be designed to provide a slight upward tilt to the label holder for more convenient viewing by prospective customers.

In one embodiment of the invention, the cross bar element consists of an integral section of the label support arm which is bent at a right angle with respect to the shaft of the label support arm. In another embodiment, the cross bar element consists of an integral section of the label support arm disposed at a right angle with respect to the shaft of the label support arm where the cross bar element is connected to the shaft by an intermediate section bent at a 45° angle with respect to both the shaft and the cross bar element. In yet another embodiment, the cross bar element is connected to the shaft of the label support arm by an intermediate section at a 45° angle (as above) and a second, end section extends from an opposite end of the cross bar element towards the shaft of the label support arm forming a triangular end portion.

For a more complete understanding of the above and other features and advantages Of the invention, reference should be made to the following detailed description of a preferred embodiment of the invention and to the accompanying drawings.

DESCRIPTION OF THE DRAWINGS

FIG. 5 is a perspective side elevational view of a second preferred embodiment of the invention.

FIG. 6 is a plan view of the merchandise display hook of FIG. 5.

FIG. 7 is a side elevational view of the merchandise display hook of FIG. 5.

FIG. 8 is a perspective view of a third preferred embodiment of the invention.

FIG. 9 is a plan view of the merchandise display hook of FIG. 8.

FIG. 10 is a side elevational view of the merchandise of the invention display hook of FIG. 8.

DESCRIPTION OF A PREFERRED EMBODIMENT

Figures 1, 2, 3, 4:
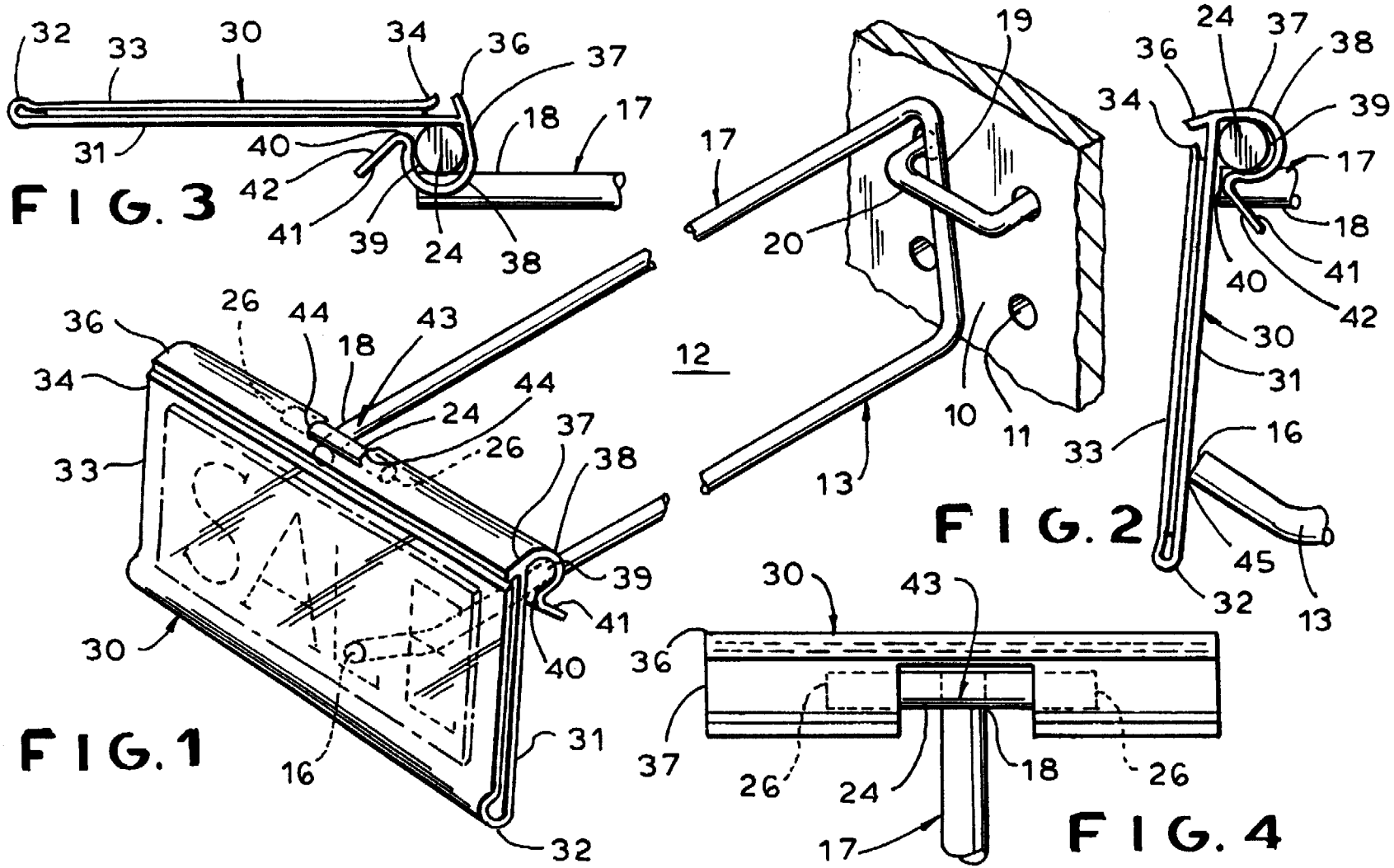
FIG. 1 is a perspective view of one preferred embodiment of a merchandise display hook according to the invention.
FIG. 2 is an enlarged, fragmentary side elevational view, illustrating front portions of the display hook of FIG. 1, showing a label-holding device in a normal or rest position.
FIG. 3 is a fragmentary side elevational view, similar to FIG. 2, illustrating the label-holding device in an upwardly pivoted position.
FIG. 4 is a fragmentary front elevational view of the device as shown in FIG. 3.
Figure 11:
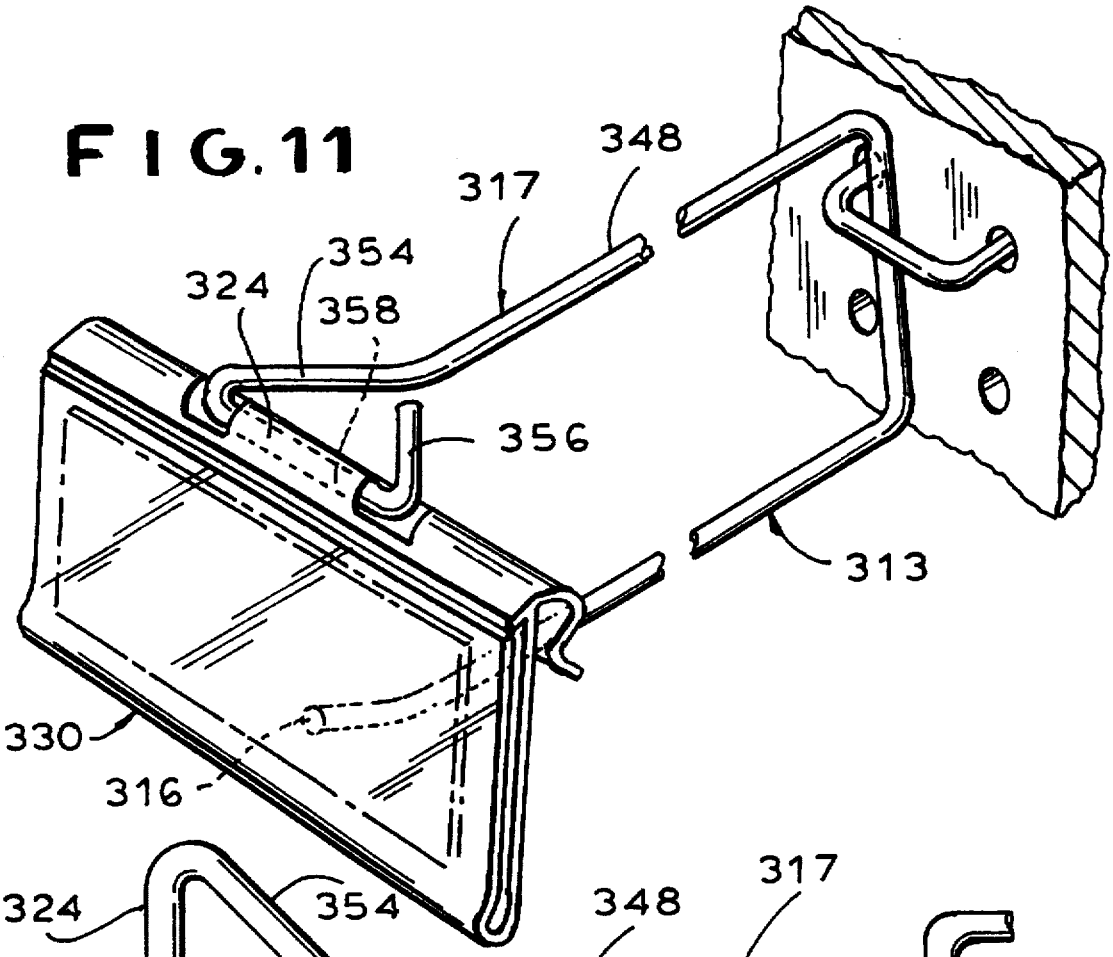
FIG. 11 is a perspective view of a fourth embodiment of the invention
Figure 12:
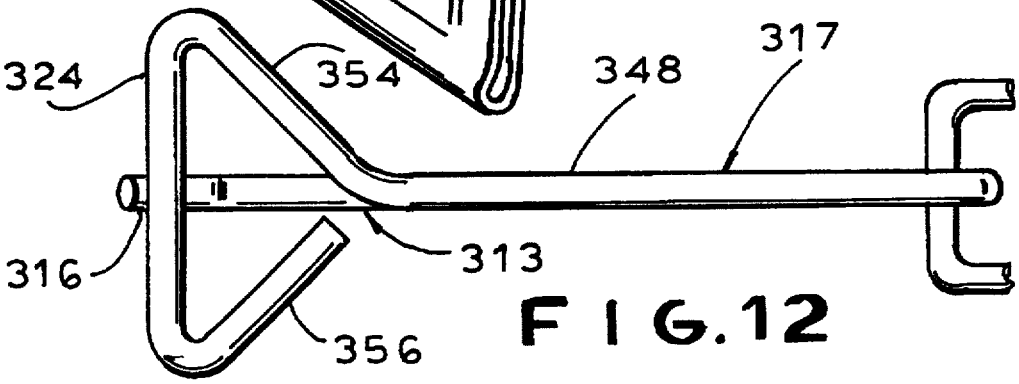
FIG. 12 is a plan view of the merchandise display hook of FIG. 11.
Figure 13:
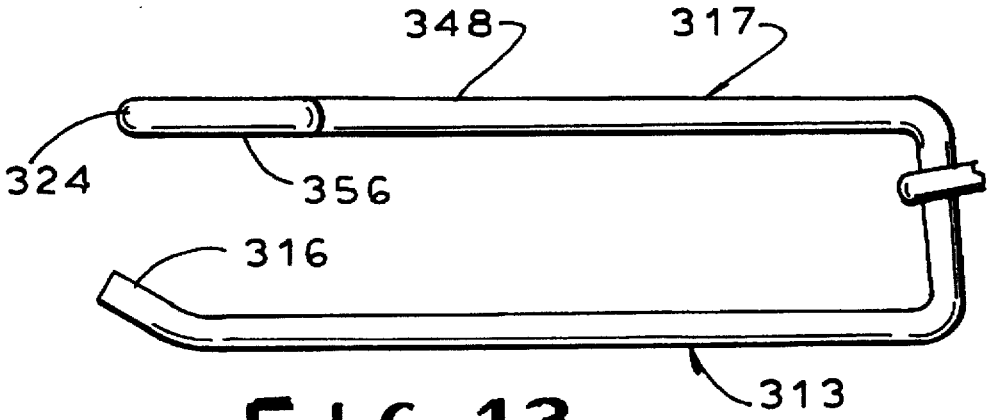
FIG. 13 is a side elevational view of the merchandise display hook of FIG. 11.

Referring now to the drawing, the reference numeral 10 designates a section of apertured panel board provided with a grid of openings 11. Conventionally, the openings 11 are provided over the entire surface of the panel 10 and are spaced uniformly, both horizontally and vertically. A merchandise display hook 12 is conventionally provided with mounting lugs (not shown) which are inserted through an adjacent pair of apertures 11 in the board 10 in order to support the merchandise hook 12 in the manner illustrated in FIG. 1, with operative portions of the display hook extending outward from the face of the panel board.

In the form of the invention illustrated in FIGS. 1–4, the hook 12 includes a merchandise supporting element 13 and a label supporting arm 17 which extends above and generally parallel to the merchandise support 13, with the outer end portion 16 of the merchandise supporting element 13 positioned slightly beyond and slightly below the end extremity 18 of the label support arm 17. The label support 17 and merchandise supporting element 13 may be integrally formed from one piece such that they are connected by a leg 19. Mounting lugs (not shown) may be connected to a bar 20 for engaging openings 11 and the panel 10.

In the embodiment of the invention shown in FIGS. 1–4, the outer end portion 16 of the merchandise supporting element 13 is bent upward at an angle, preferably about 40° or so, to the horizontal. A label supporting cross bar 24 may be welded to the outer surface of the end portion 18 of the label support arm 17 at a point spaced above and rearwardly of the end section 16. As shown particularly in FIGS. 1 and 4, the cross bar 24 is mounted symmetrically with end portions 26 thereof, extending laterally on each side. Whereas in accordance with prior knowledge, a label supporting cross bar element, such as the element 24, is welded directly to an end face of the straight wire section 17, preferably the cross bar is welded to an outer surface of the wire section 17.

Mounted on the cross bar 24 is a plastic label holder, generally designated by the reference numeral 30. The label holder may in large part be of known design and construction. It is preferably of extruded or coextruded semi-rigid, plastic construction and comprises a flat back panel 31 joined along a bottom edge 32 with a clear front panel 33. The front and back panels 33, 31, and the bottom connection 32 are so arranged that the front panel tends to close elastically against the front face of the back panel 31. However, by pressing rearwardly against the bottom portion 32, the upper lip 34 of the front panel can be sprung forward from the back panel 31 to accommodate the placement and retrieval of product information and pricing labels 35.

Desirably, a forwardly projecting guard flange 36 is provided along the upper edge of the back panel 31, to normally overlie the upper edge 34 of the front panel.

A hinge-forming flange 37 projects rearwardly from the upper edge of the back panel 31 and includes a U-shaped retaining clip portion 38 defining a forwardly facing U-shaped recess 39 of a size to receive the cross bar element 24. At its lower edge extremity 40, the U-shaped flange portion 38 is bent sharply downward and rearward, and supports an integral, downwardly divergent guide flange 41. The guide flange 41 is angled downwardly at about 45° with respect to the plane of the back panel 31 and extends for a sufficient distance to provide a relatively wide entrance 42 through which the guide bar 24 may be pressed when installing the label holder on the cross bar. Thus, by placing the guide flange 41 in contact with a cross bar 24 and pressing downward on the top of the retaining flange 37, the lower portion of the retaining flange will be cammed open by the guide flange 41. As soon as the cross bar 24 enters the chamber 39, the retaining flange 37 elastically closes to the position shown in FIGS. 2 and 3, so that the label holder is reliably connected to the cross bar 24 while being free to pivot with respect thereto.

As shown in FIGS. 1 and 4, the retaining flange portions 37, 38, and the guide flange 41, may be slotted at 43, in the center of the label holder, so that inner side edges 44 of the slotted portion straddle the wire end section 18, and serve to maintain the label holder properly centered with respect to the label support arm 17.

As shown particularly in FIG. 2, the length of the upwardly directed outer end section 16 of the merchandise support element 13, the angle at which it is directed, and the position of the cross bar 24 are all arranged such that, when a label holder is installed on the cross bar 24, the end section 16 of the merchandise support element 13 engages the back surface of the label holder back panel 31, to position the label holder by limiting the rearward pivoting movement thereof. Preferably, and as illustrated in FIG. 2, the forwardmost surface portions of the cross bar 24 lie slightly behind a vertical plane contacting the forward corner extremity 45 of the end section 16. The arrangement is such that the flat panels 31, 33 of the label holder tilt slightly upward with respect to vertical, to facilitate reading of the label holder by a customer.

In a modified version of the invention shown in FIGS. 5–7, a cross bar 124 may be formed as an integral section of a label support arm 117 by bending the label support arm 117 at a right angle thereby forming a shaft 148 and the cross bar element 124. As above, an outer end section 116 of a merchandise support arm 113 is located so that a label holder 130 tilts upward with respect to vertical.

In another embodiment shown in FIGS. 8–10, a cross bar 224 may be formed by bending a label support arm 217 in two places so as to form a shaft 248, an intermediate section 254 and the cross bar 224. The cross bar 224 may include a raised portion (not shown) which engages a space (also not shown) in a clip portion 238. Also, an outer end section 216 is located so that a label holder 230 is supported at a slightly upward angle.

In another embodiment, a label support 317 includes three bends so as to form a shaft 348, an intermediate section 354, a cross bar 324 and an end section 356 thereby creating a triangular section at the end thereof. Again, a cross bar 324 may include a raised portion (not shown) which engages a space (also not shown) in a clip portion 338. Also, an outer end section 316 is located such that a label holder 330 is supported at a slightly upward angle.

It should be understood, of course, that the specific form of the invention herein illustrated and described is intended to be representative only. In this respect, the specific form of the merchandise display hook employing the new label-mounting feature may take any of a variety of forms. Likewise, the plastic label holder itself may be constructed in various ways consistent with the present invention. Accordingly, reference should be made to the following appended claims in determining the full scope of the invention.

We claim:

1. A merchandise display hook with pivoting label holder, which comprises, (a) an outwardly extending merchandise support element, (b) an outwardly extending label holder arm having a shaft and a cross bar member, (c) said cross bar member being fixed substantially perpendicular to said shaft of said label holder arm for the support of a label holder, (d) means associated with an inner end of said display hook for mounting said display hook on a support structure, (e) a label holder-mounted on said cross bar member and having a label panel for retaining a product information label, (f) said label holder including a cross bar engaging clip portion for mounting said label holder on said cross bar member, (g) said cross bar engaging clip portion and said label holder being freely pivotally mounted on said cross bar to accommodate easy product removal from said merchandise support element from a position below said label holder arm, and (h) a label holder positioning support carried by said merchandise support element and engageable with a back portion of said label panel, (i) said positioning support being adapted to support said panel in an at-rest position at an easily-visible, upwardly inclined angular orientation and to prevent rearward pivoting movement of said label holder beyond said easily visible, upwardly inclined at-rest orientation while accommodating free pivoting movement of said label holder in a forward direction for product removal and loading.

2. A merchandise display arm according to claim 1, wherein (a) said merchandise support element has an upwardly directed outer end section and an end face, (b) said cross bar member being closer to said display panel than said end face of said merchandise support element.

3. A merchandise display arm according to claim 2, wherein (a) said cross bar element is connected to said shaft by an intermediate section, and (b) said shaft, said intermediate section and said cross bar element are integral and comprise a single piece of material.

4. A merchandise display arm according to claim 3, wherein said intermediate section is substantially at 45° angles with respect to said shaft and said cross bar element.

5. A merchandise display arm according to claim 4, wherein said label support arm and said merchandise support element are integral and comprise a single piece of material.

6. A merchandise display arm according to claim 3:

(a) wherein said intermediate member is connected to a first end of said cross bar, and (b) further comprising an end section connected to a second end of said cross bar, said end section extending from said cross bar toward said label holder arm, and (c) wherein said shaft, said intermediate section, said cross bar element, and said end section are integral and comprise a single piece of material.

7. A merchandise display arm according to claim 6, wherein (a) said intermediate section and said end section are substantially at 45° angles with respect to said label holder arm and with respect to said cross bar, and (b) said cross bar is substantially perpendicular to said shaft.

8. A merchandise display arm according to claim 7, wherein said label support arm and said merchandise support element are integral and comprise a single piece of material.

9. A merchandise display hook with pivoting label holder, which comprises, (a) an outwardly extending merchandise support element, (b) an outwardly extending label holder arm having a shaft and a cross bar member, (c) said cross bar member being fixed substantially perpendicular to said shaft of said label holder arm for the support of a label holder, (d) means associated with an inner end of said display hook for mounting said display hook on a display panel, (e) a label holder mounted on said cross bar member and having a label panel for retaining a product information label, (f) said label holder including a cross bar engaging clip portion extending rearwardly and downwardly with respect to said label panel, (g) said cross bar engaging clip portion and said label holder being freely pivotally mounted on said cross bar to accommodate easy product removal from a position below said label holder arm, and (h) a label holder positioning support carried by said merchandise support element and engageable with a back portion of said label panel to support said panel in an easily visible angular orientation and to prevent rearward pivoting movement of said label holder beyond said easily visible angular orientation while accommodating free pivoting movement of said label holder in a forward direction, (i) said merchandise support element having an upwardly directed outer end section and an end face, (j) said cross bar member being closer to said display panel than said end face of said merchandise support element, (k) said shaft and said cross bar element of said label holder arm comprising a single piece of material bent substantially at a right angle.

10. A merchandise display arm according to claim 9, wherein said label support arm and said merchandise support element are integral and comprise a single piece of material.

11. A merchandise display hook with pivoting label holder, which comprises, (a) an outwardly extending merchandise support element, (b) an outwardly extending label holder arm having a shaft and a cross bar member, (c) said cross bar member being fixed substantially perpendicular to said shaft of said label holder arm for the support of a label holder, (d) means associated with an inner end of said display hook for mounting said display hook on a display panel, (e) a label holder mounted on said cross bar member and having a label panel for retaining a product information label, (f) said label holder including a cross bar engaging clip portion extending rearwardly and downwardly with respect to said label panel, (g) said cross bar engaging clip portion and said label holder being freely pivotally mounted on said cross bar to accommodate easy product removal from a position below said label holder arm, and (h) a label holder positioning support carried by said merchandise support element and engageable with a back portion of said label panel to support said panel in an easily visible angular orientation and to prevent rearward pivoting movement of said label holder beyond said easily visible angular orientation while accommodating free pivoting movement of said label holder in a forward direction, (i) said merchandise support element having an upwardly directed outer end section and an end face, (j) said cross bar member being closer to said display panel than said end face of said merchandise support element, (k) said cross bar engaging clip portion including a space provided along a center line of said label holder, (l) said space being of a width slightly greater than the width of said label holder arm, whereby to hold said label holder in a center position while accommodating free upward pivoting movement of said label holder.

* * * * *